United States Patent [19]

Sanchez

[11] Patent Number: 4,483,450

[45] Date of Patent: Nov. 20, 1984

[54] CONTAINER AND REMOVABLE LID THEREFOR

[76] Inventor: Gil Sanchez, RFD 4-1033, Bayamon, P.R. 00619

[21] Appl. No.: 551,070

[22] Filed: Nov. 14, 1983

[51] Int. Cl.[3] ..... B65D 41/32

[52] U.S. Cl. ..... 215/254; 215/10

[58] Field of Search ..... 215/1 A, 10, 254, 229

[56] References Cited

U.S. PATENT DOCUMENTS 3,140,007 7/1964 Nettleship ..... 215/10
3,369,687 2/1968 Walls ..... 215/10
3,421,681 1/1969 Frank ..... 215/254
3,933,264 1/1976 Rossi ..... 215/254

*Primary Examiner*—George T. Hall
*Attorney, Agent, or Firm*—McAulay, Fields, Fisher, Goldstein & Nissen

[57] ABSTRACT

A rigid container having a metal or plastic lid seal cap for bottling contents such as beverages therein, the cap having tabs on its depending circumferential flange for easy removal and a central convex ring configuration to provide increased rigidity to the seal and nesting and stacking strength. Optionally, a peelable opaque film can be removable secured on the container to protect the contents from light. Upon removal of the film, the container may be used as a household drinking glass.

19 Claims, 4 Drawing Figures

CONTAINER AND REMOVABLE LID THEREFOR

BACKGROUND OF THE INVENTION

Field of the Invention

This invention relates generally to lid and container constructions. More specifically, the invention is concerned with glass and plastic drinking containers and with a closure for such containers. Preferably the containers of the invention are shaped at their ends for stacking purposes.

The current trend in containers is to provide containers which are multifunctional. To profit from new legislation, such containers should be reusable. To satisfy consumer demand they should also have as many features of convenience adding to their manufacturing costs. Thus the containers should be useful as household wares after their contents are removed. They should be stackable to save storage and shipping space. Containers also should protect their contents from light. The closure seals of containers should be easily removable and yet have sufficient flexural strength to absorb impact forces encountered in use or during shipping. Additionally, the closures should have means for removing the contents of the container without removing the closure, if desired, for example, by inserting a straw through an opening easily made in the closure. The present constructions provides these desiderata.

DESCRIPTION OF THE PRIOR ART

Statement of Patent Disclosures

Previous patents in this field evidence considerable research and design efforts. For the sake of brevity this discussion is limited to the most pertinent patents.

Of these, U.S. Pat. No. 1,118,606 to Weissenthanner shows a sheet metal stopper comprising a top with a circumferential securing flange having at extended intervals on its inner side inward securing projections with a continuous stiffening rib below the projections.

U.S. Pat. No. 1,718,069 to Pernot discloses a dished top.

U.S. Pat. No. 1,517,396 to Boothman goes into making a glass container in such a manner that it does not become unsightly for future use as a glass container without the contents in it.

U.S. Pat. No. 1,345,722 to White provides a cap in which the shaping thereof is effective to provide a hermetic seal, which also forms part of a friction seal.

U.S. Pat. No. 4,256,240 to Woinarski is a very specific structure to provide for the attachment of a plastics material closure to a plastic container with the closure also being provided with a channel to the outer top portion to provide for resting of the next container on top.

U.S. Pat. No. 2,978,142 to Norvick also shows self-stacking cans with complementary interengaging means. But, there is no showing of any tab opening.

U.S. Pat. No. 3,989,142 to Gwilliam, Jr., et al. shows a stackable container lid for a container adapted to contain hot food. The only opening in the lid is a vent hole, and this is not the type of opening used in accordance with the teachings of the invention.

None of the above patents in anyway hints at or otherwise suggests the present invention.

SUMMARY OF THE INVENTION

There is provided in accordance with this invention a rigid container having a metal or plastic lid seal cap for bottling contents such as beverages therein, the cap having spaced tabs at extended intervals on its depending circumferential flange for easy removal and a central convex ring configuration to provide increased rigidity to the seal and nesting and stacking strength. Optionally, a peelable film can be removable secured on the container to protect the contents from light. Upon removal of the film, the container may be used as a household drinking glass. The lid can be formed with a tearable pouring or drinking opening.

The lid can either remain on the container or be removable and for this purpose, preferably two tabs are provided so that the entire lid can be removed. The tabs can be opposite to each other or orthogonally related. The lid is provided on opposite sides of the tabs with conventional score lines which can be made with a stamping operation. A further feature of the invention is the provision of a transverse score line connecting the score lines on opposite sides of at least one of the tabs and spaced approximately one-eighth of an inch or about 0.32 centimeters from the central convex ring.

To these ends, the invention consists in the provision of a container lid which includes a top surface having a raised convex center and an upstanding inner wall at the periphery of the surface, a top wall extending from the inner wall and connecting the inner wall to a depending outer flange of greater length and forming a space therebetween adapted to fit on the rim of a container, the inner wall and the surface forming a dished configuration, and a plurality of spaced scored sections radiating at extended intervals from the center along the top surface part way down the outer flange and terminating in a tab for removing the lid from a container.

The invention further includes a container associated with the lid, the container having an open top and a closed bottom with the top being wider than the bottom such that the lid is adapted to fit sealingly over the top of the container, the inner wall of the lid and the surface thereof forming a dished surface having a dished configuration for receiving the bottom of a similar container in nesting relation.

DISCLOSURE OF BEST MODE

Figure 1:
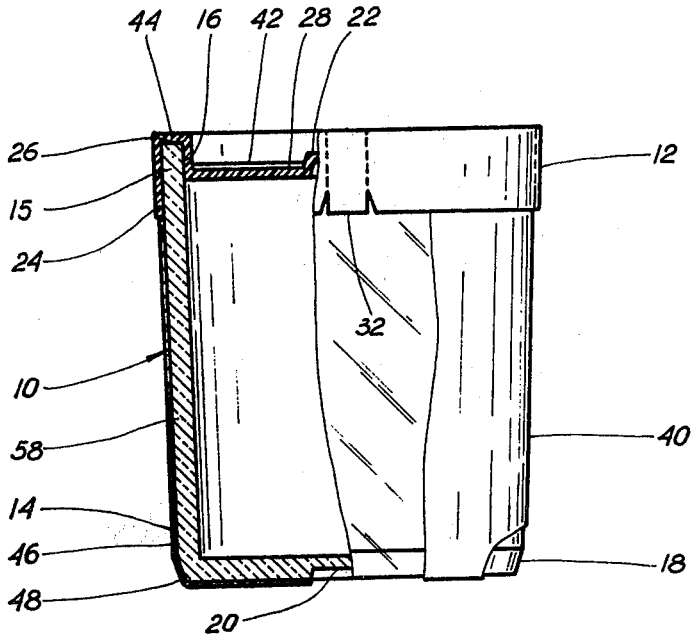
FIG. 1 is an elevational partly sectioned view of one embodiment of a container and lid according to the invention.

Referring now descriptively to the drawing, the invention is seen to include a container construction 10 and a lid 12 therefor. Container 10 is formed conventionally of any material such as metal, waterproof cardboard, plastic or any other suitable rigid material and preferably capable of substantially retaining its shape when used. The container is a drinking glass as in FIG. 1 or goblet as in FIG. 3 and has an open upper part of larger width or diameter than its closed base 14 as defined by its upstanding wall 15. Base or bottom 14 and the container can be round but a square container may be desirable to increase the quantity of containers which can be shipped and packed into a shipping carton.

Regardless of the shape of base 14 in a preferred embodiment, it has a beveled outer periphery at 18 and a central inner recess or channel 20.

Container 10 is hermetically sealed by closure lid 12 which has a dished upper portion forming a central wall 42 so dimensioned nestingly to receive therein the base 14 of a similar container. Lid 12 is formed with a convex reinforcing raised center 22 so dimensioned as to be received in the central inner channel 20 of the next similar container. On its periphery, lid 12 includes upstanding inner wall 16 connected integrally to flange 24. The space between wall 16 and flange 24 is so dimensioned that the lid fits sealingly on the top of container 10 by press fitting around top edge 26 of the container.

Figure 2:
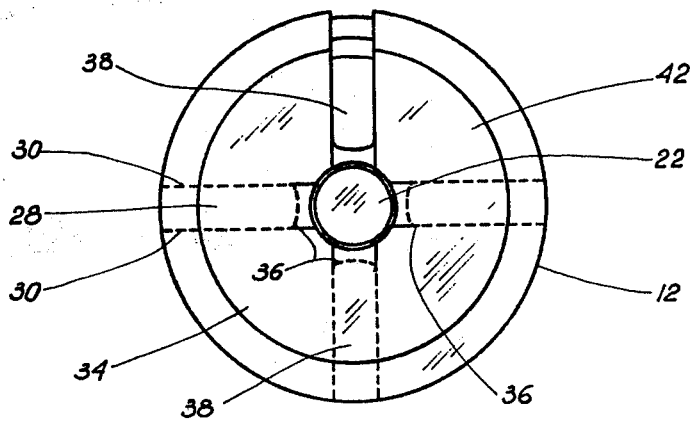
FIG. 2 is a top plan view of the closure of the invention having one tab and its associated section between the score lines removed to provide for a drinking opening with the lid in place on the container.

Lid 12 has a plurality of spaced scored sections 28 at extended intervals on its surface radiating from center 22 and extending part way down flange 24 as shown in FIG. 2. Score lines 30 are spaced on opposite sides of each of the sections 28. At least two of these weakened sections terminate in cut out lift tabs 32 to facilitate removal of the lid from the container. All four of the weakened sections can terminate in the cut out lift tabs 32.

The scored sections which at their width between adjacent pairs of score lines 30 suitably are approximately onehalf of an inch wide and may be embossed or stamped in the lid along with center 22; this center 22 prevents the sections from being torn completely across the whole top 34.

Preferably, at least one of the scored sections 28 may be itself transversally scored at 36 near center 22 so that it may be entirely torn off and removed to form a drinking or pouring opening 38 in the lid (see FIG. 2). Preferably scoring 36 is semi-circular or arcuate further to facilitate removal of the scored section by pulling on tab 32. Scored section 28 can be completely removed and prevented from falling into the container. Score line 36 is preferably spaced approximately one-eighth from the periphery of center 22. It is possible to remove two or more scored sections 28 so that the entire lid can be removed.

Lid 12 may be made of plastic such as "Lexan" polycarbonate, polyethylene or other plastic material or of metal such as aluminum.

As shown in FIG. 2, the scoring is cruciform but other patterns of scoring are substantially functionally equivalent.

If desired, the outside of container 10 may have adhered thereto by means of any suitable adhesive and opaque peelable plastic or metal foil layer 40 to shield its contents from light. Suitable materials for this purpose include "Mylar" plastic and aluminum tin foil.

Raised portion 44 has an inner diameter slightly less than the outer diameter of the outer portion 46 of the side wall 58 of container 10. To facilitate the insertion of outer portion 46 (FIG. 2) into central well 42 which is surrounded by raised portion 44, the bottom of the wall of container 10 is beveled at 48.

Figure 3:
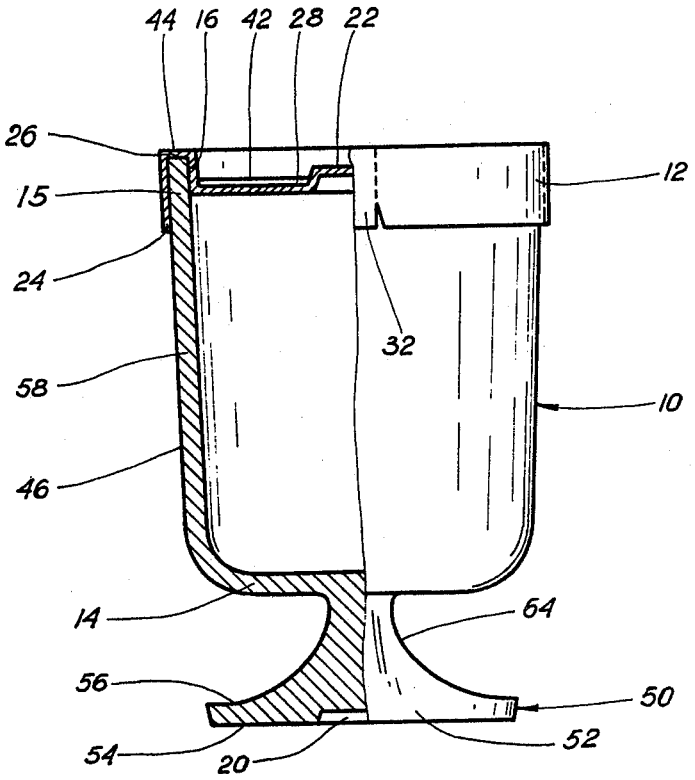
FIG. 3 is a partial elevational view partly sectioned of another embodiment of the invention showing an alternative embodiment of the invention with another form for the bottom thereof.

The present container shown as having a mouth wider than its body may assume any desired form. Instead of being in the form of a drinking glass, it can be a goblet as shown in FIG. 3, with a pedestal 50 formed with a base 52 and a narrowed portion 64. Formed in base 52 is a channel or central inner recess 20 to cooperate with center 22. Base 52 is dimensioned so as to nest in well 42 of lid 12 of the next similar goblet, and of a size enabling it to interlock with center 22 of the lid.

To facilitate insertion of base 52 into well 42, the base tapers outwardly from the bottom 54 to the top 56 so that base 52 snugly fits within raised portion 44.

Figure 4:
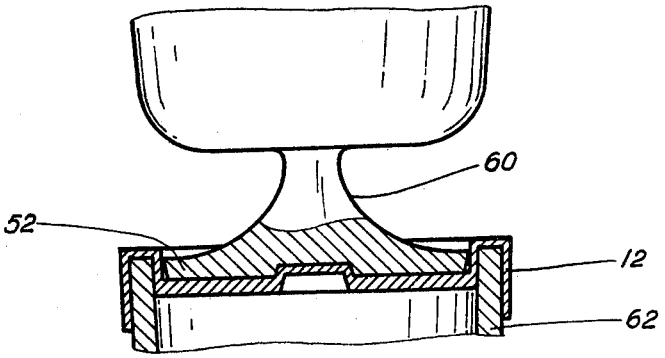
FIG. 4 is a partial sectional view in elevation of two of the containers and associated lid shown in a stacked condition.

FIG. 4 illustrates two goblets wherein the base 52 of one goblet 60 is nested within the closure lid of another goblet 62.

While the primary utilization of the present construction is for liquid beverages it will be understood that it can accommodate other substances including preserves, jellies, yogurts, etc.

It will be noted that the novel lid of the invention by its construction makes possible stacking of the containers and the provision of a pouring opening both as a result of forming therein the convex center or raised ring 22.

It will also be noted that the novel lid of the invention makes it possible to provide for a pouring or drinking opening as well as the possibility of removal of the lid when at least two of the tabs 32 and the section 28 between score lines 30 is removed or partly separated from the top 34 of lid 12. With this construction there are no burrs on the drinking surface when tab 32 is torn off. If there are any burrs, it is below the top surface 34.

Although the invention as has been described is deemed to be that which would form the preferred embodiments of the invention, it is recognized that departures may be made therefrom without departing from the scope of the invention which is not to be limited to the details disclosed, but is to be accorded the full scope of the claims so as to include any and all equivalent closures.

What is claimed is:

1. A container lid comprising:

a top surface having a raised convex center;

an upstanding inner wall at the periphery of said surface;

a top wall extending from said inner wall and connecting said inner wall to a depending outer flange of greater length and forming a space therebetween adapted to fit on the rim of a container;

said inner wall and said surface forming a dished configuration; and a plurality of spaced scored sections radiating at extended intervals from said center along said top surface part way down said outer flange and terminating in a tab for removing said lid from a container.

2. The lid of claim 1, wherein at least one of said sections has semi-circular transverse scoring whereby part of said section may be severed from said lid to form a pouring or drinking opening without removing said lid from said container.

3. The lid of claim 1, wherein said scored sections are cruciformly disposed.

4. The lid of claim 1, formed from plastic.

5. The lid of claim 1, formed of metal.

6. The lid of claim 5, formed of aluminum.

7. The lid of claim 1, wherein said raised convex center and said scored sections are formed by stamping or embossing.

8. A container and lid combination comprising:

a container having an open top and a closed bottom, said top being wider than said bottom; and a lid adapted to fit sealingly over said top of said container;

said lid comprising:

a top surface having a raised convex center;

an upstanding inner wall at the periphery of said surface;

a top wall extending from said inner wall to a depending outer flange of greater length and forming a space therebetween adapted to fit on the rim of said container;

said inner wall and said surface forming a dished surface having a dished configuration for receiving the bottom of a similar container in nesting relation; and a plurality of spaced scored sections radiating at extended intervals from said center along said top surface part way down said outer flange and terminating in a tab for removing said lid from said container.

9. The container and lid of claim 8, wherein said bottom of said container has a beveled periphery to facilitate nesting in the lid of a similar combination.

10. The container and lid of claim 8, wherein said bottom of said container has a central recess adapted to receive therein said raised center of the lid of a similar combination.

11. The container and lid of claim 8, wherein the outside of said container has adhered thereto a peelable opaque film to protect contents from light.

12. The container and lid of claim 8, wherein said container is of the goblet type including a pedestal; and said pedestal includes a base dimensioned so as to fit within the lid of a similar combination.

13. The container and lid of claim 12, wherein said base includes a central interlocking recess dimensioned to receive the raised convex center of the lid of the next similar combination.

14. The container and lid of claim 8, wherein at least one of said sections has transverse scoring whereby part of said section can be severed from said lid to form a pouring or drinking opening.

15. The container and lid of claim 8, wherein said transverse scoring is semi-circular.

16. The container and lid of claim 8, wherein said transverse scoring is spaced approximately one-eighth of an inch from said raised convex center.

17. The lid of claim 2, wherein said transverse scoring is spaced approximately one-eighth of an inch from said raised convex center.

18. The lid of claim 1, wherein at least one of said sections has an arcuate transverse scoring spaced about one-eighth of an inch from said center whereby part of said section may be severed from said lid to form a pouring or drinking opening without removing said lid from said container and permitting complete removal of part of said section.

19. The container and lid of claim 12, wherein said base includes a central interlocking recess dimensioned to receive the raised convex center of the lid of the next similar combination to provide for stacking of the container and lid combination and interlocking of the stacked container and lid combination.

* * * * *